United States Patent [19]

Faller

[11] Patent Number: 4,905,921

[45] Date of Patent: Mar. 6, 1990

[54] CUTTING DEVICE

[76] Inventor: Alexander Faller, Rottenburger Str. 14, 8305 Ergoldsbach, Fed. Rep. of Germany

[21] Appl. No.: 304,923

[22] Filed: Feb. 1, 1989

Related U.S. Application Data

[63] Continuation of Ser. No. 134,735, Dec. 18, 1987, abandoned.

[51] Int. Cl.[4] ..... B02C 4/30

[52] U.S. Cl. ..... 241/294; 29/121.2

[58] Field of Search ..... 29/121.1–121.8; 241/260.1, 293, 73, 294, 224, 295, 289, 239, 241, 242

[56] References Cited

U.S. PATENT DOCUMENTS

| | | | |
|---|---|---|---|
| 2,529,286 | 11/1950 | Fraser | 29/121.2 X |
| 4,597,538 | 7/1986 | Getz | 241/294 X |
| 4,739,939 | 4/1988 | Panning | 241/294 |

FOREIGN PATENT DOCUMENTS

| | | | |
|---|---|---|---|
| 2843664 | 4/1980 | Fed. Rep. of Germany | 241/293 |

*Primary Examiner*—Mark Rosenbaum

*Attorney, Agent, or Firm*—Cohen, Pontani & Lieberman

[57] ABSTRACT

A device for cutting articles into chips, having a rotating milling roller (12) which is provided on its periphery with cutting tools which are formed as cutting teeth (26) protruding from a chain (30) which is helically wrapped on the periphery of the milling roller (12) and which has its two ends fastened in the region of the two face ends (22) of the milling roller (12).

13 Claims, 4 Drawing Sheets

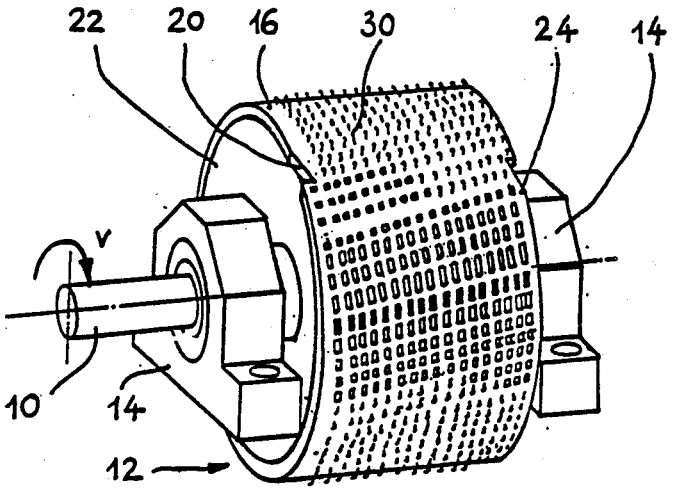
Fig. 1
Fig. 2
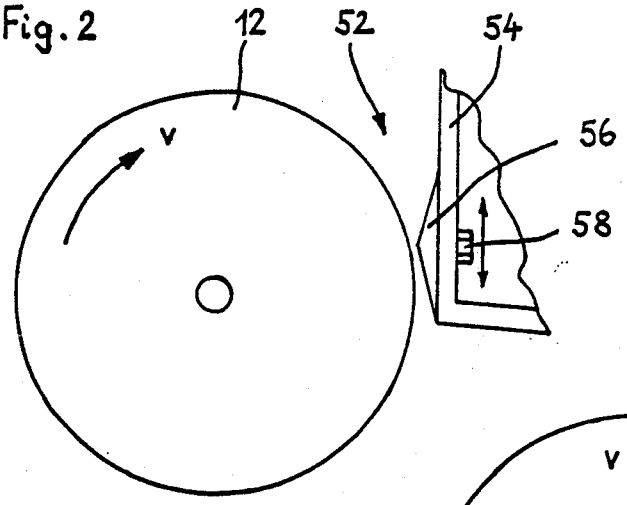
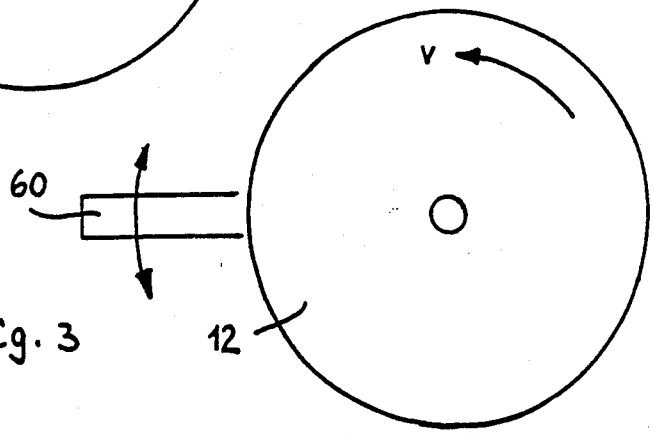
Fig. 3

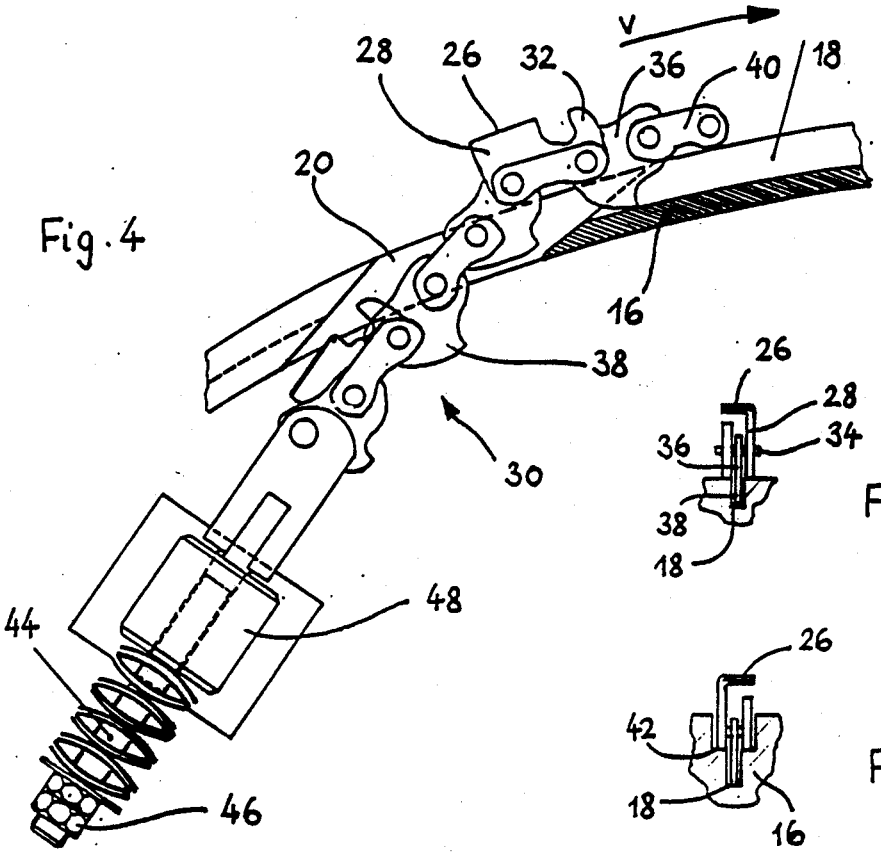
Fig. 4
Fig. 6
Fig. 7
Fig. 5
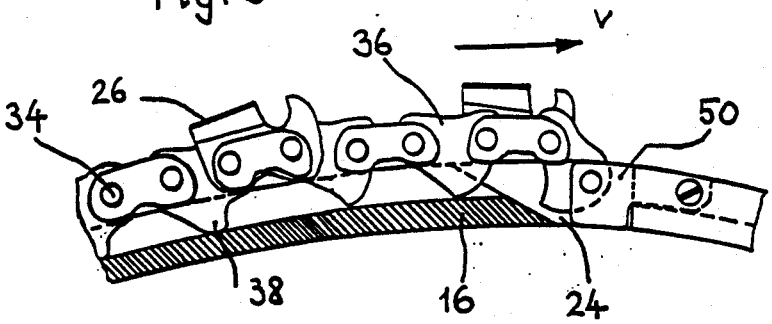

CUTTING DEVICE

This is a continuation of U.S. application Ser. No. 134,735, filed Dec. 18, 1987, now abandoned.

TECHNICAL FIELD

The present invention relates to a device for the cutting of objects into chips, and particularly to a cutting device having a rotating milling roller which is provided on its periphery with cutting tools.

BACKGROUND ART

Milling rollers for the machining of metal, in general, are composed either of a miller on the periphery of which the cutting tools are formed or of a cutter head in which the cutters are inserted on the periphery and individually attached thereto. For the removing of chips from softer objects, for instance of wood, choppers are known which also have a rotating knife head bearing the individual cutting knives on its periphery.

DESCRIPTION OF THE INVENTION

An object of the present invention is to provide a device for the removing of chips from objects of preferably soft material which is of substantially simpler construction than previously known devices and which permits rapid removal of the cutting tools, for instance for regrinding or replacement.

In a device of the above-described type, this object is achieved in accordance with the present invention in that the cutting tools are cutting teeth which protrude from a chain which is wrapped helically on the periphery of the milling roller and the two ends of which are fastened in the region of the two face ends of the milling roller.

Such a device is of extremely simple construction since it is composed essentially only of a drum-shaped body which is driven by a motor and which is bearing the chain on its outer periphery. In most cases it is sufficient to use a commercial saw chain for this purpose. In practice it has been found that with such a device most objects can be cut into very small chips, whereby, due to the helical wrapping of the chain and the overlap of successive cutting teeth obtained thereby, a very effective cutting, milling or chopping is effected.

If the cutting teeth on the chain links are provided with fingers which determine the depth of penetration and which protrude in front of each cutting tooth as seen in the direction of rotation of the milling roller, then the thickness of the chip can be determined as desired by selecting the height of the fingers.

To secure the chain on the milling roller, the latter is provided with a helical groove on its outer periphery, in which the chain is being guided.

In this connection, the chain can engage into the groove by means of feet of connecting links, which feet face the roller axis while double links articulated on both ends to the connecting links lie on the outer periphery of the milling roller.

It is also possible for the feet of the connecting links to engage into the groove while the double links rest on a shoulder which is provided in the milling roller on both sides of the groove.

In particular for silo filling or similar cases of use it is advantageous for the milling roller to be formed of two worms which engage in each other and the turns of which are arranged a distance apart forming the groove.

In accordance with another feature of the present invention, the rear end of the chain, as seen in the direction of rotation, is attached with initial tension to the milling roller. This way it is achieved that, in operation, the chain is always loaded in the direction towards the elastically clamped end so that, as a result of the initial tension, loosening of the chain tension will not occur.

The milling roller can be arranged within a feed shaft for the objects to be milled. If a vertically adjustable rejection wedge which faces the milling roller is provided in this feed shaft, the thickness of the chips can be preselected by simple means.

As a further development of the invention, the lower half of the milling roller is surrounded by a screen which has the shape substantially of part of a cylinder and which is spaced slightly from the outer periphery of the milling roller. By this measure, chips which are still too large after the first chipping process are carried along again by the milling roller so that they again enter into the cutting zone until they are cut to such a small size that they finally fall downward through the screen.

To prevent hard foreign bodies from damaging or destroying the device, the limiting wall of the filling shaft which extends approximately tangentially to the milling roller is mounted swingably towards the outside in the entrance region of the feed shaft. The limiting wall is preferably swingable outward against spring force.

The device according to the present invention is suitable for the comminuting of the most diverse objects, for instance sugar beets, corn, fruit, wood, rubber, bones, meat, plastic or the like. Thus it is also possible for instance, to remove sprues on cast articles of plastic, fibers or the like.

In another embodiment or modification a guide member for the object to be worked is arranged substantially radially to the milling roller. This guide member is preferably swingably mounted. With this embodiment of the device, the milling of the radii of workpieces of wood, plastic or the like is possible, the recess desired in each case being obtainable by swinging the guide member.

The invention is explained below with reference to various embodiments which are shown in the drawing, in which:

FIG. 1 is a perspective view of the device according to the present invention wherein the housing has been omitted from the drawing to enhance clarity;

FIG. 2 is a diagrammatic end view of the milling roller together with a part of a feed shaft;

FIG. 3 is similar to FIG. 2, and shows another embodiment having a swingable guide member;

FIG. 4 is an enlarged partial view of the end of the chain which is fastened with initial tension;

FIG. 5 is an enlarged partial view of the end of the chain which is clamped fast;

FIG. 6 is a cross sectional view through the chain, showing the groove guiding the chain;

FIG. 7 is similar to FIG. 6, and shown another embodiment having a differently developed groove;

Figure 8:
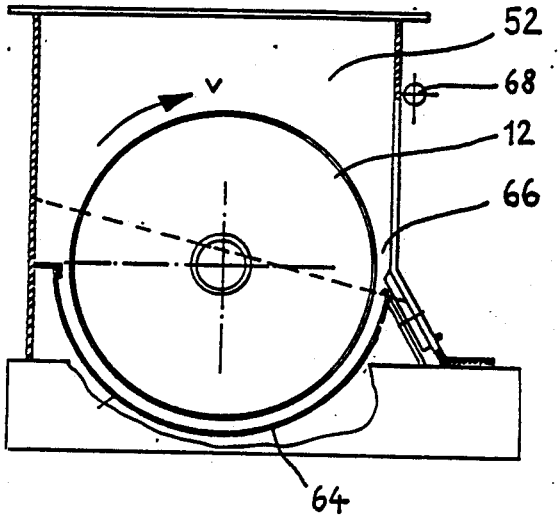
FIG. 8 is a diagrammatic end view of a modified device according to the present invention.

As shown in FIG. 1, a cylindrical milling roller 12 is fastened on a rotatably driven shaft 10 the direction of rotation of which is indicated by the arrow v. The shaft 10 is mounted between bearing blocks 14 which are fastened in a housing which is indicated in FIG. 8.

In the cylindrical wall 16 of the milling roller 12 there is a helical groove 18 (shown in FIGS. 4, 6 and 7) which commences from a notch 20 on one face end 22 of the milling roller 12 and terminates at a notch 24 at the opposite face end of the milling roller 12.

The cutting tools of the device are cutting teeth 26 (shown in FIG. 4) which are provided on chain links 28 of a chain 30, (also shown in FIG. 4) for instance, a commercial chain saw chain. As shown in FIGS. 4 to 7, the cutting teeth 26 protrude from the upper end of the chain links 28 and extend approximately in horizontal direction. In front of each cutting tooth 28, as seen in the direction of rotation v, a finger 32 is provided on the chain link 28, the finger lying somewhat lower than the cutting tooth 26, thereby determining the depth of penetration of the cutting tooth into the material to be worked. Connecting links 36 are articulated to each chain link 38 via pins 34 (shown in FIGS. 6 and 7) on both sides, a foot 38 protruding downward from each connecting link. Every two connecting links 36 are connected together by double links 40 articulated at both ends as shown in FIG. 4.

As shown in FIGS. 4 to 6, the chain 30 is guided in the groove 18 so that the feet 38, of the connecting links 36, facing the roller axis engage into the groove 18 while the double links 40 lie on the outer periphery of the wall 16 of the milling roller 12.

In the embodiment indicated in FIG. 7 the groove 18 is developed deeper in the wall 16 of the milling roller 12 so that the cutting teeth 26 are at a smaller distance from the outer periphery of the milling roller 12. In this embodiment, the double links 40 lie on a shoulder 42 which is provided in the wall 16 of the milling roller 12 on both sides of the groove 18.

FIG. 4, shows, in larger view, the notch 20 at the face end of the milling roller 12 which is to the left in FIG. 1. In the region of this notch 20 the rear end of the chain 30, as seen in the direction of rotation v, is attached with initial tension to the face end 22 of the milling roller 12. A spring assembly 44 is arranged between a fixed clamping point 46 on the face end of the milling roller 12 and an adjustable tensioning member 48.

The tensioning member 48 is connected in known manner to the end of the chain 30. Due to this initial tension at the end of the chain 30 which is towards the rear in the direction of rotation v, the chain is loaded in operation continuously in opposition to the direction of rotation v so that the chain tension is substantially maintained.

FIG. 5 shows the front end of the chain 30, as seen in the direction of rotation. The chain is fastened firmly to the other face end of the milling roller 12 by means of a fastening member 50.

In FIG. 2 there is indicated a feed shaft 52, within which the milling roller 12 is arranged. On the limiting wall 54 of the feed shaft 52 which faces the milling roller 12 there is fastened a rejection wedge 56 which can be fixed in place by a screw 58 or the like after adjusting it to the desired height (see double-ended arrow in FIG. 2).

The vertical position of the rejection wedge 56 determines the desired thickness of the chips of the material fed into the feed shaft 52.

In the embodiment shown in FIG. 3, instead of the feed shaft 52 with rejection wedge 56, there is provided a guide member 60 which extends approximately radially to the milling roller 12 and is swingably mounted, as indicated by the double-ended arrow in the drawing. A piece of wood, plastic or the like which is to be worked can be pushed via this guide member 60 against the milling roller 12 for effecting a radius milling.

FIG. 8 shows another embodiment of the present invention in which the lower half of the milling roller 12 is surrounded by a screen 64 which is substantially in the shape of a part of a cylinder and is spaced slightly from the outer periphery of the milling roller 12. This screen 64 has the purpose that chip parts which are still too large are carried along by the milling roller 12 rotating in the direction of rotation v and are fed again toward the entrance region 66 of the feed shaft 52 until these chips are so small that they drop down through the screen 64.

Figure 9:
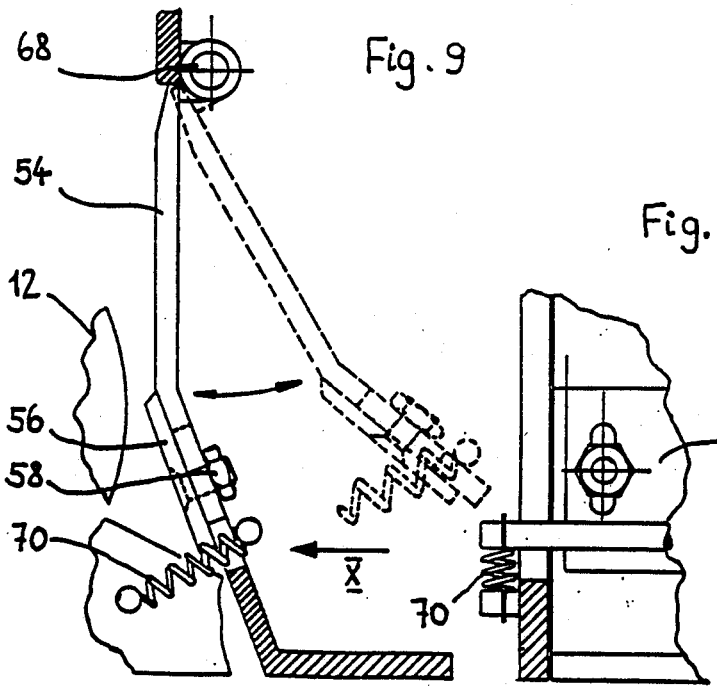
FIG. 9 is an enlarged partial view of the entrance region of the filling shaft according to FIG. 8.
Figure 10:
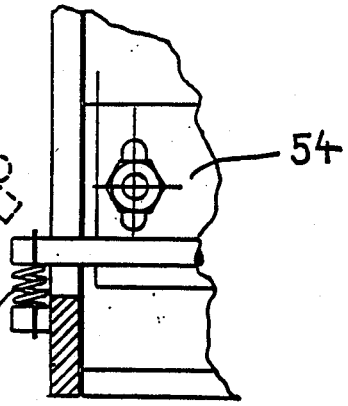
FIG. 10 is a front view of the partial region, seen in the direction of the arrow X in FIG. 9.

FIG. 9 shows, an enlarged view of the entrance region 66 of the feed shaft 52 which are illustrated in FIG. 8. It can be noted herefrom that the limiting wall 54 which extends approximately tangentially to the milling roller 12 and which bears the rejection wedge 56 is mounted swingably outward on a shaft 68 which is parallel to the axis of the drum. In this way the limiting wall 54 can open towards the outside should hard foreign bodies, for instance stones, come into the entrance region 66 of the feed shaft 52. These foreign bodies then drop outward so that damage or destruction of the milling roller 12 is avoided.

A spring 70 causes the limiting wall 54 to swing back into the closed position.

Figure 11:
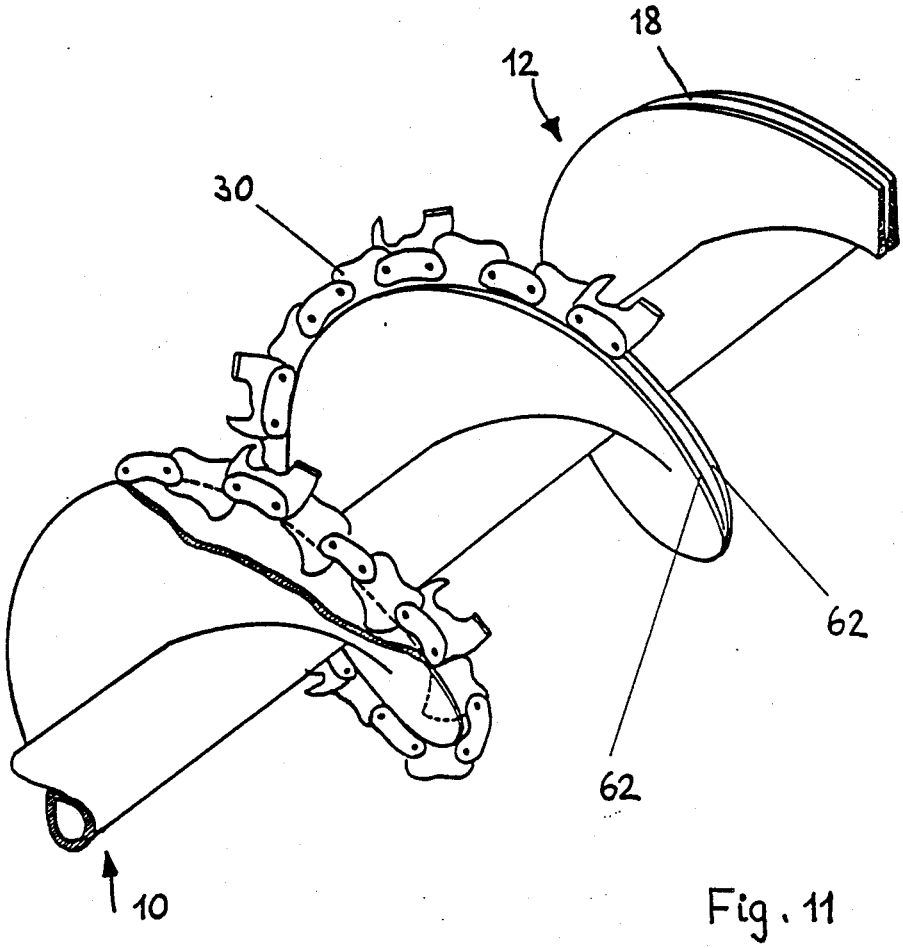
FIG. 11 is a perspective view of a milling roller which is formed from two worms.

FIG. 11 shows another embodiment of the device in which the milling roller 12 is formed by two worms 62 which engage in each other. The worms 62 are arranged in such a manner that their turns are arranged at distance from each other which forms the groove 18. In order to produce the desired spacing, spacer elements (not shown) can be provided between the turns of the two worms 62. The worms 62 are then firmly connected with each other via these spacer members.

As in the previously described embodiment, the chain 30 is in this case also inserted into the groove 18, the pitch being determined by the pitch of the worm. This variant is suitable in particular for use as a silo filler.

Finally, there is also the possibility of winding the chain 30, whose connecting links 36 are not provided with feet, on the smooth outer surface of the milling roller 12 in which no groove is present. In this case it is advisable for the chain windings to be wound tightly against each other without any space between them.

Another possible use for the device of the present invention is as a follow-up device in corn choppers for reducing corn kernels or as a field chopper for additional chopping of other fruits.

What is claimed is:

1. A device for cutting articles into chips comprising:

a rotating milling roller (12) comprising an outer periphery and two face ends (22); a helical groove (18) in said periphery; a chain (30) having links and two ends guided in said groove (18) and wrapped helically around said periphery and having said two ends fastened in the region of said two face ends (22) of said milling roller (12); and cutting teeth (26) forming cutting tools protruding from said chain (30).

2. The device according to claim 1, wherein said cutting teeth (26) are formed as part of a chain link (28) and a finger (32) protruding from said chain link in front of each cutting tooth (26) as seen in the direction of rotation of said milling roller (12) determining the depth of penetration thereof.

3. The device according to claim 2, wherein said milling roller (12) is formed by two worms (62) having turns and engaging into each other; said turns being spaced apart for forming said groove (18).

4. The device according to claim 1, additionally comprising connecting links (36) having feet (38) for engaging said chain (30) into said groove (18); said feet facing the axis of said roller; and double links (40) being articulated at both ends to said connecting links (36) located on the outer periphery of said milling roller (12).

5. The device according to claim 1, additionally comprising connecting links (36), having feet (38) for engaging said chain (30) into said groove (18); said feet facing the axis of said roller; a shoulder (42) within said periphery of said milling roller on both sides of said groove; and double links (40) being articulated at both ends to said connecting links (36) and resting on said shoulder (42).

6. The device according to claim 1, wherein the rear end of said chain (30) as seen in the direction of rotation (v), is attached with initial tension to the milling roller (12).

7. The device according to claim 1, wherein said milling roller (12) is arranged within a feed shaft (52) having limiting wall (54) and an entrance region (66).

8. The device according to claim 7, additionally comprising a rejection wedge (56) of adjustable height located within said feed shaft (52) and facing said milling roller (12).

9. The device according to claim 7, additionally comprising a screen (64) forming substantially a part of a cylinder, spaced at a distance from said outer periphery of said milling roller (12) and surrounding the lower half of said milling roller (12).

10. The device according to claim 7, wherein said limiting wall (54) is extending substantially tangentially to said milling roller (12), and is mounted in outwardly swingable manner within said entrance region (66) of said filling shaft (52).

11. The device according to claim 10, wherein said limiting wall is swingable outward against spring pressure.

12. The device according to claim 1, additionally comprising a guide member (60) for the article arranged substantially radially to said milling roller (12).

13. The device according to claim 12, wherein said guide member (60) is swingably mounted.

* * * * *